United States Patent [19]

Crown

[11] 4,111,241

[45] Sep. 5, 1978

[54] SPRING FORMING MEANS IN AUTOMATIC COIL SPRING ASSEMBLING MACHINE

[75] Inventor: Barry S. Crown, Chicago, Ill.

[73] Assignee: Burton-Dixie Corporation, Chicago, Ill.

[21] Appl. No.: 811,056

[22] Filed: Jun. 29, 1977

[51] Int. Cl.[2] ..... B21F 27/16

[52] U.S. Cl. ..... 140/92.7; 140/3 CA; 72/137

[58] Field of Search ..... 29/33 F, 33 Q, 563; 72/128, 137; 140/3 CA, 92.7

[56] References Cited

U.S. PATENT DOCUMENTS

| | | | |
|---|---|---|---|
| 1,716,093 | 6/1929 | Stackhouse | 140/3 CA |
| 1,905,459 | 4/1933 | Gail | 140/3 CA |
| 2,779,860 | 1/1957 | Conrad | 72/137 X |
| 3,010,491 | 11/1961 | Pearson | 72/137 X |
| 3,205,915 | 9/1965 | Kamp | 140/3 CA |
| 3,313,325 | 4/1967 | Wells | 72/137 X |
| 3,334,665 | 8/1967 | Black | 140/92.7 |

*Primary Examiner*—Horace M. Culver

*Attorney, Agent, or Firm*—McDougall, Hersh & Scott

[57] ABSTRACT

Automatic machinery for producing assemblies of coil springs wherein wire is fed to a coiling station for the formation of individual coil springs and wherein transport equipment delivers the coil springs to an assembly station where the springs are tied together into complete assemblies. Indentation means are located for forming indentations in the opposite end convolutions of each coil spring prior to delivery to the assembling station. The indentation means include dies positioned in the path of movement of the transport equipment, and the movement of the transport equipment is stopped as each spring is positioned in the area of the dies. The dies then operate to form the indentations in the respective convolutions.

8 Claims, 20 Drawing Figures

Fig-20
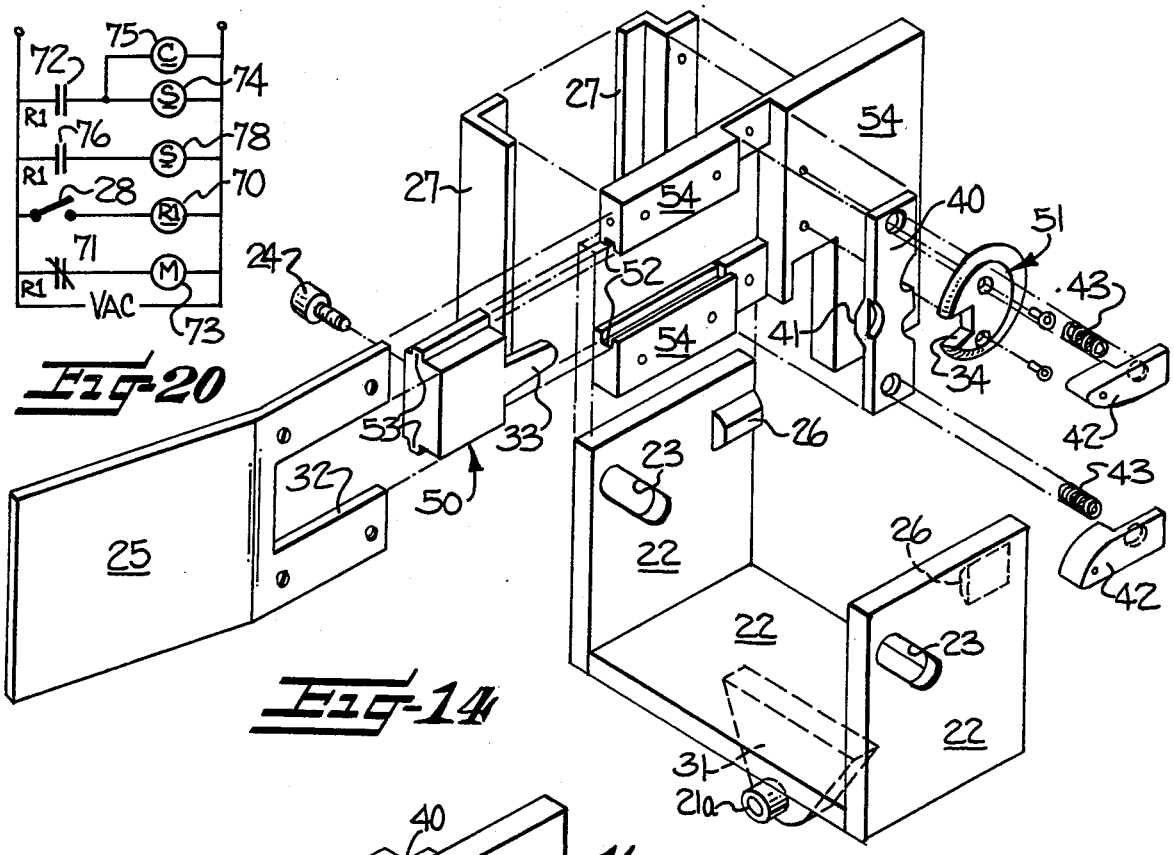
Fig-14
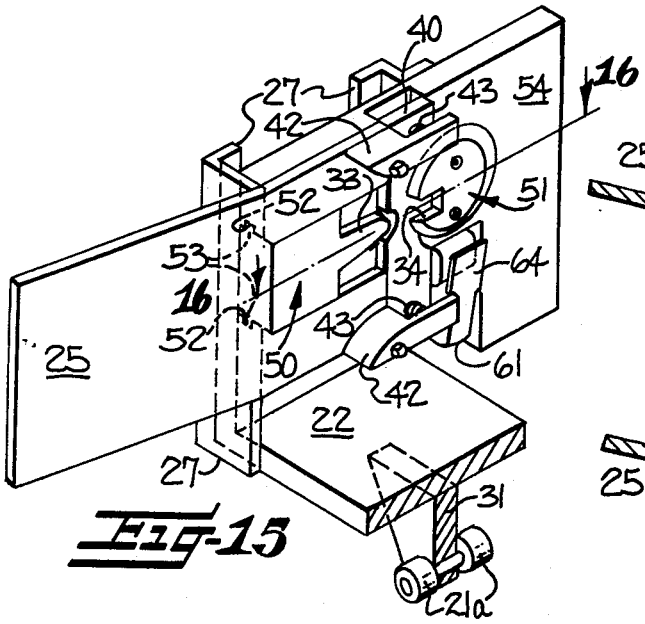
Fig-15
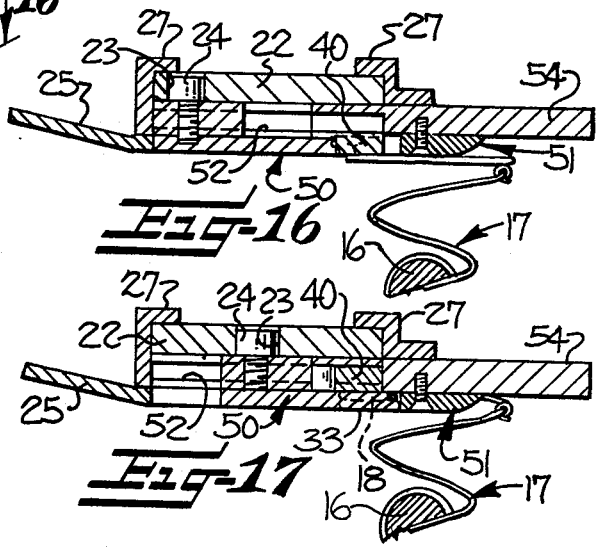
Fig-16
Fig-17
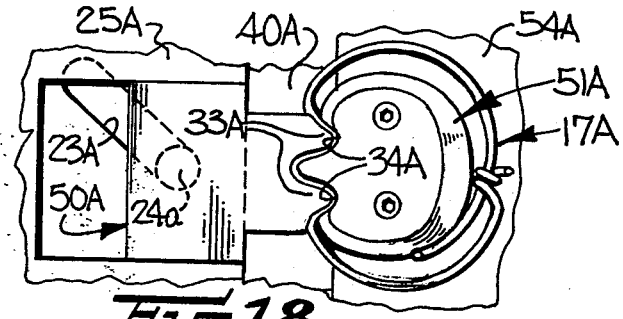
Fig-18
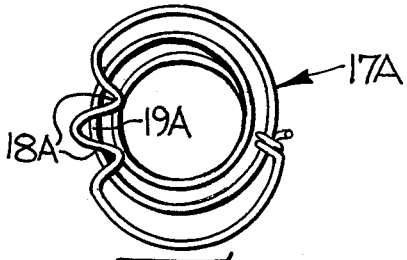
Fig-19

SPRING FORMING MEANS IN AUTOMATIC COIL SPRING ASSEMBLING MACHINE

This invention relates to automatic coil spring equipment. The invention is particularly concerned with equipment of the type adapted to receive a length of wire which is fed to a coiling station of the machine. The wire is severed into lengths and convolutions formed therein to achieve the individual coil springs. A transport arm carries the individual springs to an assembly station where the springs are tied together to achieve assemblies useful in mattresses, cushions, and the like. Such machinery preferably also includes additional stations such as for attaching knots to the individual springs and for heat treating purposes. A typical machine of the type with which this invention is concerned is known as a Spuhl transfer unit manufactured by Spuhl Limited in Switzerland.

Machinery of the type referred to is quite satisfactory from the standpoint of producing what would be considered to be standard coil springs for mattress and spring cushion assemblies. It has been found, however, that such equipment is not adapted to the formation of spring designs which are more efficient when utilized in such mattress and spring cushion applications. Reference is made in particular to the spring cushion design described in Contino Pat. No. 2,182,069.

The spring design described in the aforesaid patent provides for more efficient assemblies since the springs have an increased resiliency whereby greater firmness can be achieved when utilizing the same number of these springs as compared with conventional springs. Alternatively, the springs described in the aforementioned patent can be utilized to achieve a degree of firmness in an assembly even though fewer of the patented springs are used than in an assembly of conventional springs having the same firmness.

The patented spring design can thus achieve savings in the amount of wire used for purposes of achieving a mattress assembly of a given firmness. It will be appreciated that a lighter gauge wire could be employed in an assembly to achieve the same firmness as an assembly of a corresponding number of springs of conventional design formed of higher gauge material. As explained in the aforementioned patent, the patented design also has the advantage of reducing the wear of insulating material which is positioned immediately adjacent the spring assembly in a mattress or spring cushion. This also achieves savings since longer life can be expected when springs of the patented design are employed.

Despite the efficiencies available when utilizing the springs of the patented design, such springs have not been employed since automatic equipment has not been available which would form such springs. In the absence of such automatic equipment, the efficiencies obtained with the patented spring design were not great enough to warrant use. Thus, the labor costs involved in producing mattress and cushion spring assemblies on other than automatic equipment would not warrant the use of the patented springs even in light of the efficiencies achieved with the patented springs.

It is a general object of this invention to provide an improved automatic spring making and assembling apparatus whereby springs of the type described in the aforementioned U.S. Pat. No. 2,182,069 can be efficiently used in mattress and cushion spring assemblies.

It is a more specific object of this invention to provide an apparatus of the type described which includes the provision of a station in an automatic spring making machine, this station being specifically designed for the formation of indentations in coil springs whereby improved spring performance can be made available in automatic equipment.

These and other objects of this invention will appear hereinafter and for purposes of illustration, but not of limitation, specific embodiments of the invention are shown in the accompanying drawing in which:

FIG. 14 is an exploded isometric view of the forming die and associated structure utilized in the apparatus;

FIG. 15 is an isometric view of the structure of FIG. 14 in an assembled condition;

FIG. 16 is a fragmentary cross-sectional view taken about the line 16—16 of FIG. 15;

FIG. 17 is a fragmentary cross-sectional view of the structure of FIG. 16 at a different operating stage;

FIG. 18 is a fragmentary cross-sectional view illustrating a modified forming die construction;

FIG. 19 is an end view of a coil spring produced with the forming die of FIG. 18; and, FIG. 20 is a circuit diagram illustrating a portion of a control arrangement utilized in the construction.

This invention generally relates to automatic machinery for the production of assemblies of coil springs. The invention is particularly directed to machinery of the type involving the introduction of wire to a coiling station in the machine whereby the wire can be severed into individual lengths and individual coil springs can be formed from the lengths.

Transport means in the form of a transport arm or the like are utilized for moving the individual coil springs from station to station in the machine. In a typical operation, the transport means will move the coil springs to knot wrapping stations, to a heat treating station, and then to a transfer station. At the transfer station, the individual coils are moved to a coil assembling station. This station includes means for tying the individual coils into rows and for tying successive rows of coils together. In this manner, successive assemblies of coil springs having a desired length and width can be produced. The entire operation is automatic from the time of the introduction of the wire to the discharge of the completed assemblies.

This invention is particularly directed to the provision of means for modifying the individual coil springs which are ultimately included in the assemblies. More specifically, the invention is directed to the provision of indentation means at a station located between the coil forming station and the coil assemblies station. These indentation means are adapted to automatically form indentations in the opposite end convolutions of each coil spring formed at the coil forming station. The coil springs delivered to the coil assembling station will, therefore, each be characterized by indentations in their end convolutions.

The particular indentation means contemplated by this invention comprise reciprocally movable forming members for engaging the end convolutions of the coil springs. The transport arms utilized for moving the coil springs to the respective stations are adapted to stop momentarily to enable these dies to engage the successive coil springs. The transport arm movement is then restarted after formation of the indentations.

Figure 1:
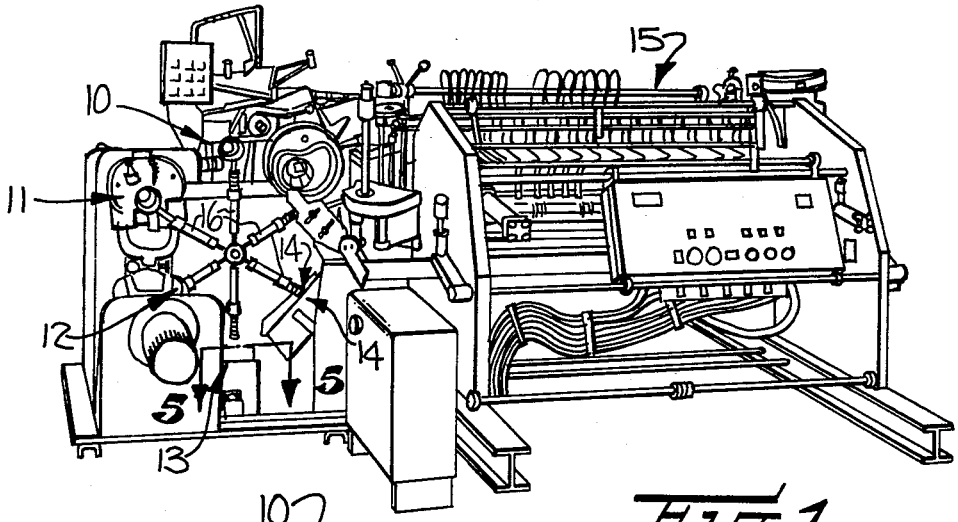
FIG. 1 is a perspective view of an automatic machine utilized for the formation of coil springs and for the assembly of the springs.

The accompanying drawings illustrate examples of structures characterized by the features of this invention. FIG. 1 illustrates an apparatus which generally conforms with the configuration of a Spuhl transfer unit for the production of spring assemblies, this apparatus being produced by Spuhl Limited of Switzerland.

Figure 2:
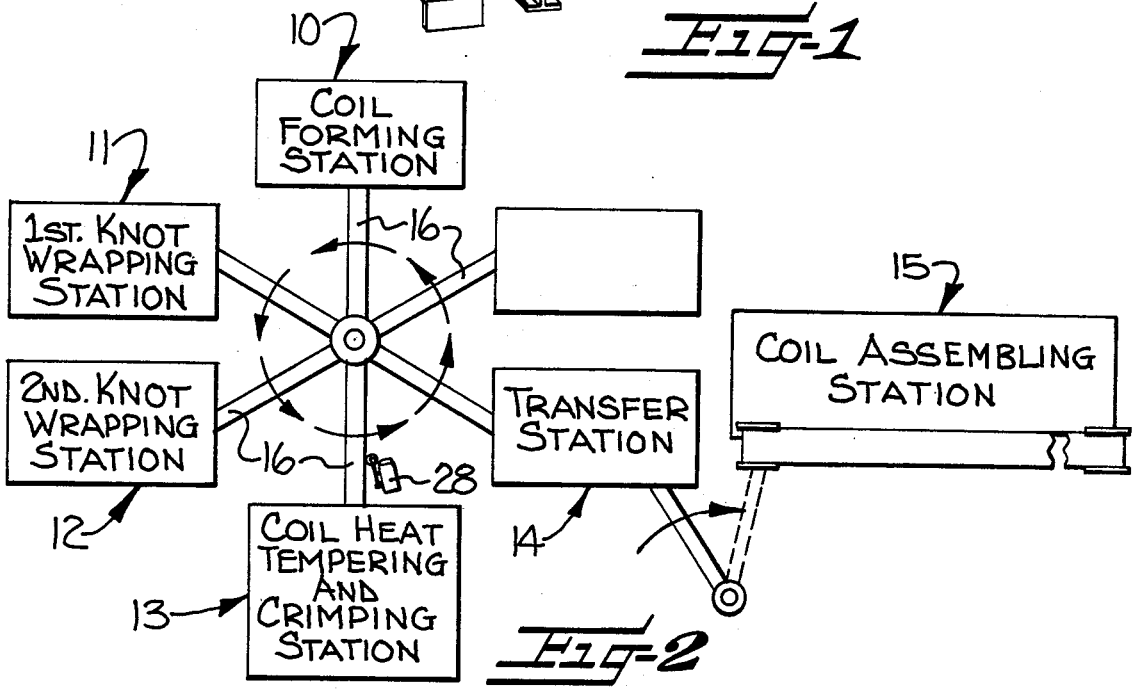
FIG. 2 is a schematic illustration of the machine operation particularly showing the operating stations in the machine.
Figure 3:
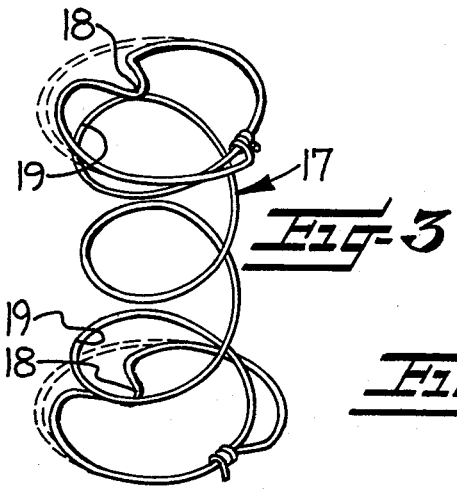
FIG. 3 is an isometric view of a coil spring produced in accordance with this invention.

The apparatus of FIG. 1 includes, as also shown in FIG. 2, a series of stations including a coil forming station 10. A length of wire is continuously fed to this station whereby individual coils can be formed in accordance with the ordinary machine operation. The next stations comprise first and second knot wrapping stations 11 and 12. These stations successively form knots at the ends of each coil produced as is best illustrated in FIG. 3.

The station 13 includes a coil heat treating (tempering) station and an indentation station. The coil heat treating is carried out in the ordinary fashion whereby the effects of work hardening resulting from the forming taking place in the earlier stations are removed. The indentation operation involves the variations which characterize this invention and will be discussed in detail hereinafter.

A transfer station 14 is also provided, this station serving to achieve the movement of completed coils to the coil assembling station 15. In the ordinary operation of the machine, the coils are formed into successive rows with the coils in the individual rows being tied together. These rows are then indexed through the machine, and a tying mechanism serves to form the rows into a complete assembly.

Figure 4:
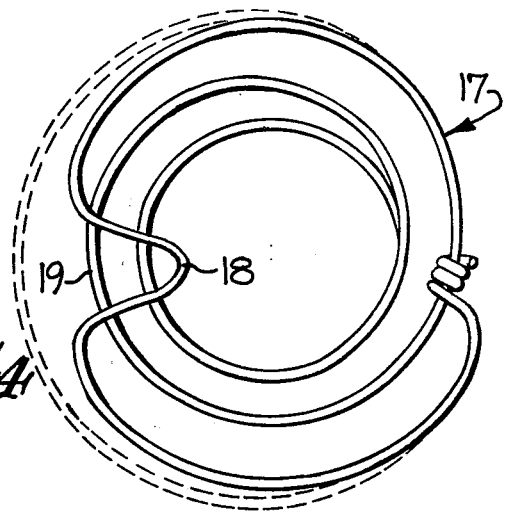
FIG. 4 is an enlarged end view of the coil spring.
Figure 5:
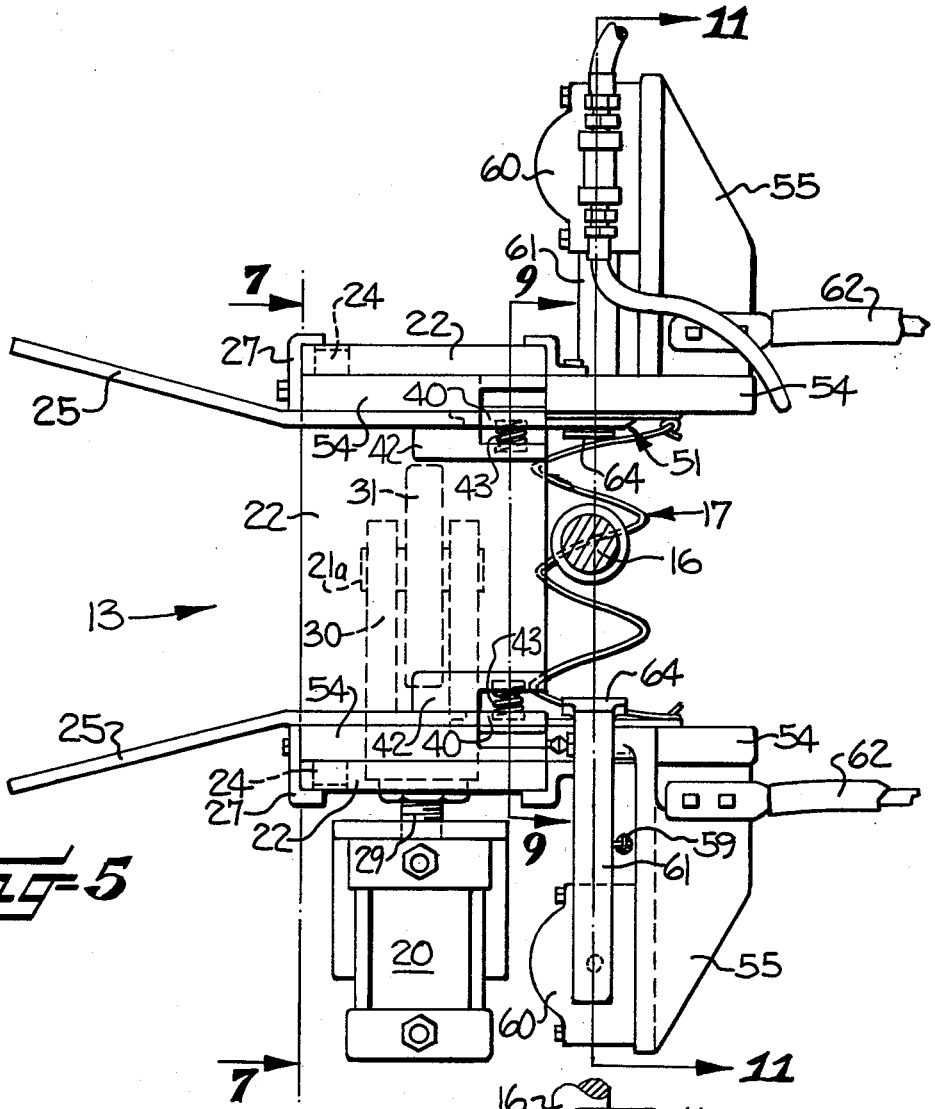
FIG. 5 is a plan view of the coil spring indentation means taken about the line 5—5 of FIG. 1.
Figure 6:
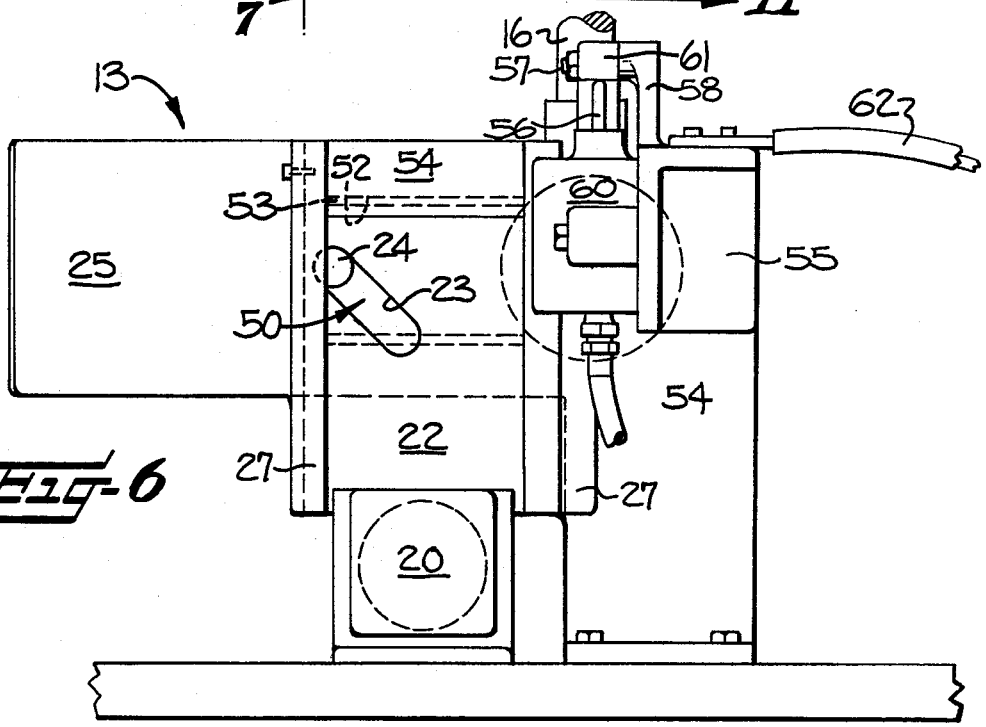
FIG. 6 is a side elevation of the apparatus of FIG. 5.
Figure 7:
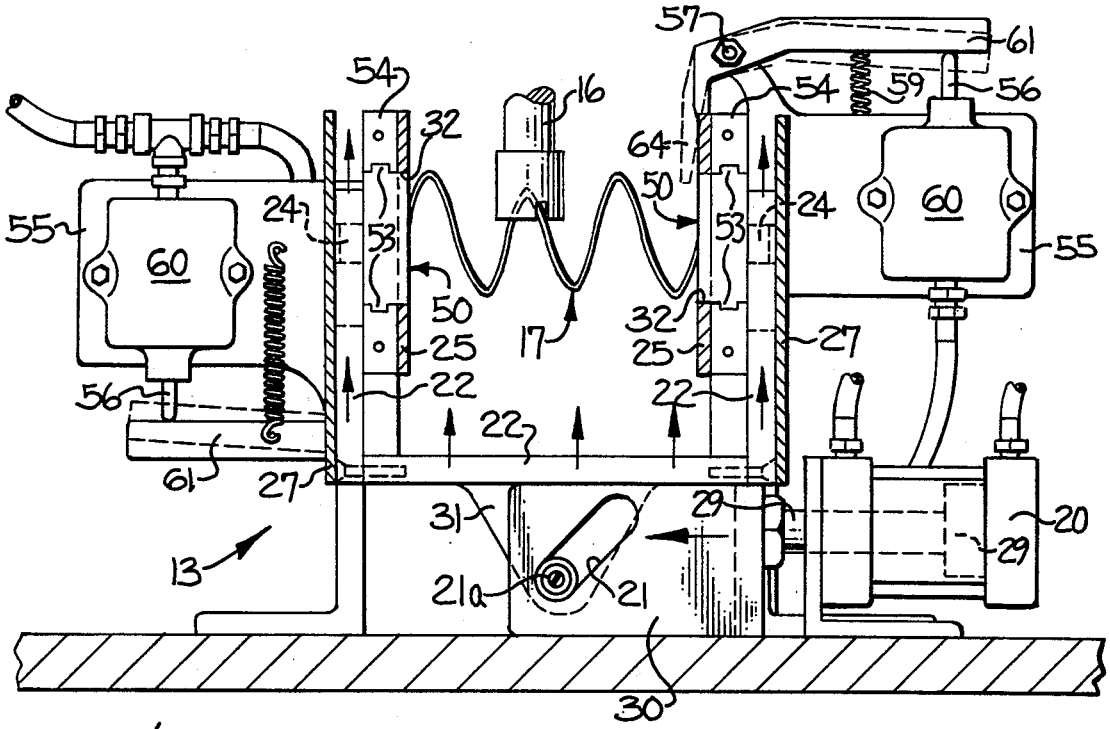
FIG. 7 is a cross-sectional view taken about the line 7—7 of FIG. 5.
Figure 8:
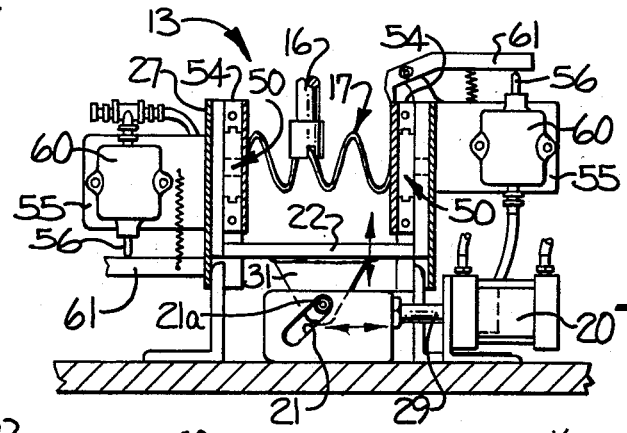
FIG. 8 is a reduced cross-sectional view illustrating the structure of FIG. 7 at a different operating stage.

As shown in FIGS. 1 and 2, the machine includes a plurality of transport arms 16. These arms radiate outwardly from a central rotary support. In the course of forming of a coil spring 17 as shown in FIGS. 3 and 4, the wire is threaded through gripping means associated with the arms whereby each coil is held by an arm until removed at the transfer station 14. This gripping arrangement may be of any conventional type utilized in machines of this nature.

As indicated, the concepts of this invention involve the formation of coil springs of the type including indentations in the end convolutions. Referring to FIGS. 3 and 4, it will be noted that indentations 18 are formed in each end convolution. As described in the aforementioned Contino U.S. Pat. No. 2,182,069, the indentations overlap the convolutions 19 adjacent the end convolutions. This provides a significant improvement in the firmness of the coil springs since upon depressing the spring, the indentations 18 will prevent the convolutions 19 from passing outwardly beyond the end convolutions. In addition to improving the firmness, the convolutions 19 will also be held out of contact with insulation normally located on opposite sides of the coil springs. This reduces wear of the insulation which results to a greater degree when the insulation is contacted by end convolutions as well as adjacent convolutions.

As previously indicated, the apparatus of this invention particularly involves the provision of an indentation station whereby the indentations 18 can be automatically formed in each coil prior to delivery of the coils to the coil assembling station. The particular mechanisms involved in accordance with a preferred form of the invention are illustrated in FIGS. 5 through 17.

The structure of FIGS. 5 through 17 is adapted to be located at the station 13 of the apparatus. Referring to FIGS. 1 and 2, it will be noted that these indentation mechanisms are positioned at the same station as the heat treating station whereby the tempering and indentation operations can be carried out substantially simultaneously.

As shown in FIGS. 5 through 17, the station 13 includes a pair of coil spring infeed plates 25. These plates are flared outwardly so that a spring in its uncompressed condition can be freely moved by a transfer arm 16 between the plates 25. As the movement of the arm continues, the opposite ends of the coil springs bear against the surfaces of the plates 25 whereby the springs are slightly compressed as they arrive at the station 13. Suitable control mechanisms, for example, a switch 28 positioned for engagement by the arms (FIG. 2), operate to stop the arm movement as each coil is properly positioned. It will be appreciated that the switch 28 can be located in any of six positions for engagement by the arms 16, and that this switch will also serve to stop the arms in a proper position relative to the other operating stations. Furthermore, it will be appreciated that any suitable control means may be employed for controlling the arm movement, and such control means do not form any part of this invention.

The mechanisms at the station 13 include a pneumatic cylinder 20 having its piston 29 connected to a bifurcated drive member 30. This drive member defines an inclined slot provided with camming surface 21. The surface 21 is provided for engagement with cam follower **21*a***.

The cam follower **21*a* comprises a pair of rollers mounted on a pin which extends through the downwardly depending section 31 of U-shaped die driver 22. The driver 22 in turn defines opposed inclined slots which define cam surfaces 23**.

Cam followers 24 are received in the slots 23. As best shown in FIGS. 16 and 17, the cam followers 24 define threaded shafts which serve to secure the cam followers to male forming die members 50.

The die members 50 are positioned for movement within the recesses 32 defined by the infeed plates 25. The plates 25 extend over opposed side plates 54, these side plates defining grooves 52 which receive splines 53 defined along the side edges of the die members 50. Also fastened to the plates 54 are opposed female die members 51. The projections 33 defined by each male die member are adapted to be received in recesses 34 defined by each female die member.

Also supported by the side plates 54 are opposed coil spring guides 42. The tapered ends of these guides insure centering of each coil spring as the spring is brought into position for forming. In this connection, it will be noted that the female die members 51 are slightly raised relative to the side plate surfaces 54. In addition, these female die members define inclined side edges so that the end convolutions of the coils are adapted to ride over the female die members and to settle around the female die members when the transfer arm comes to a stop. This locates the coil springs in the position shown in FIGS. 12 and 13.

Immediately forward of the female dies 51, the side plates 54 carry opposed stripper bars 40. The under side of each of these bars is provided with an integrally formed camming member 41. The stripper bars are held in place by means of the guides 42, and springs 43 normally urge the stripper bars away from the female dies 51. It will be noted that the stripper bars each define an edge facing the female die members and conforming thereto so that the stripper bars can be moved outwardly for receipt by the female die members in opposition to the action of springs 43.

Each of the side plates 54 has attached thereto an outwardly projecting bracket 55 which supports an air cylinder 60. The operating piston 56 of each air cylinder engages an end of one of the clamp arms 61, these clamp arms being pivotally attached to extensions 58 of brackets 55 at 57. Springs 59 normally urge the clamp arms clockwise relative to the respective pivotal mountings.

The clamp arms 61 each define clamping ends 64 which are adapted to hold the opposite end convolutions of a coil against electrodes 66. These electrodes are, in turn, utilized for resistance heating purposes whereby the desired tempering of the coil springs can be achieved. It will be appreciated that this arrangement is suitable for use where the indentation station is combined with the heat treating station. In that case, electrical leads 62 are associated with a generator 63 (FIG. 1) for providing the necessary power. Suitable alternative arrangements, including heat treating at a separate station, are contemplated.

Figure 9:
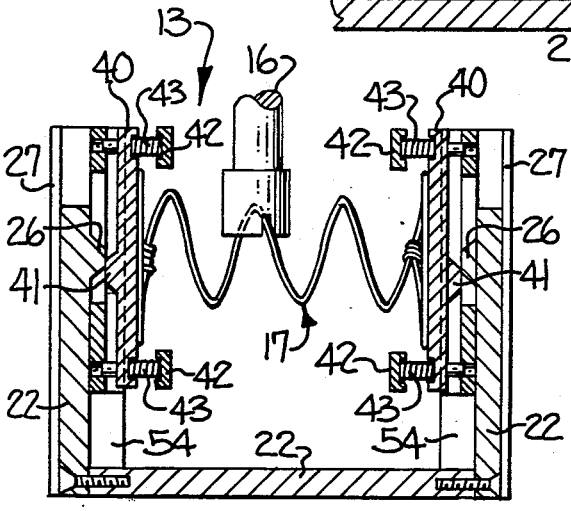
FIG. 9 is a cross-sectional view taken about the line 9—9 of FIG. 5.
Figure 10:
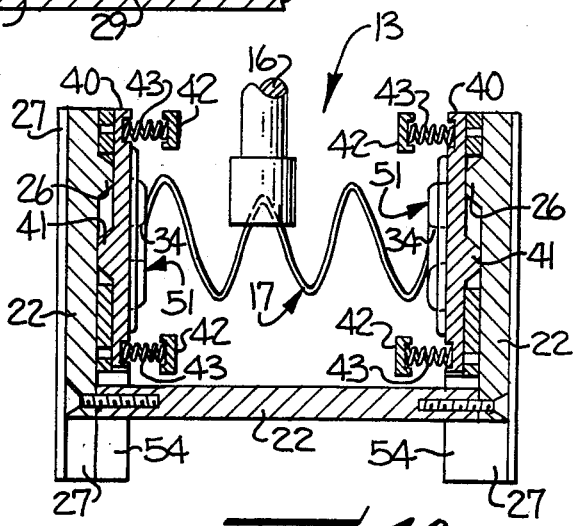
FIG. 10 is a cross-sectional view of the structure shown in FIG. 9 at a different operating stage.
Figure 11:
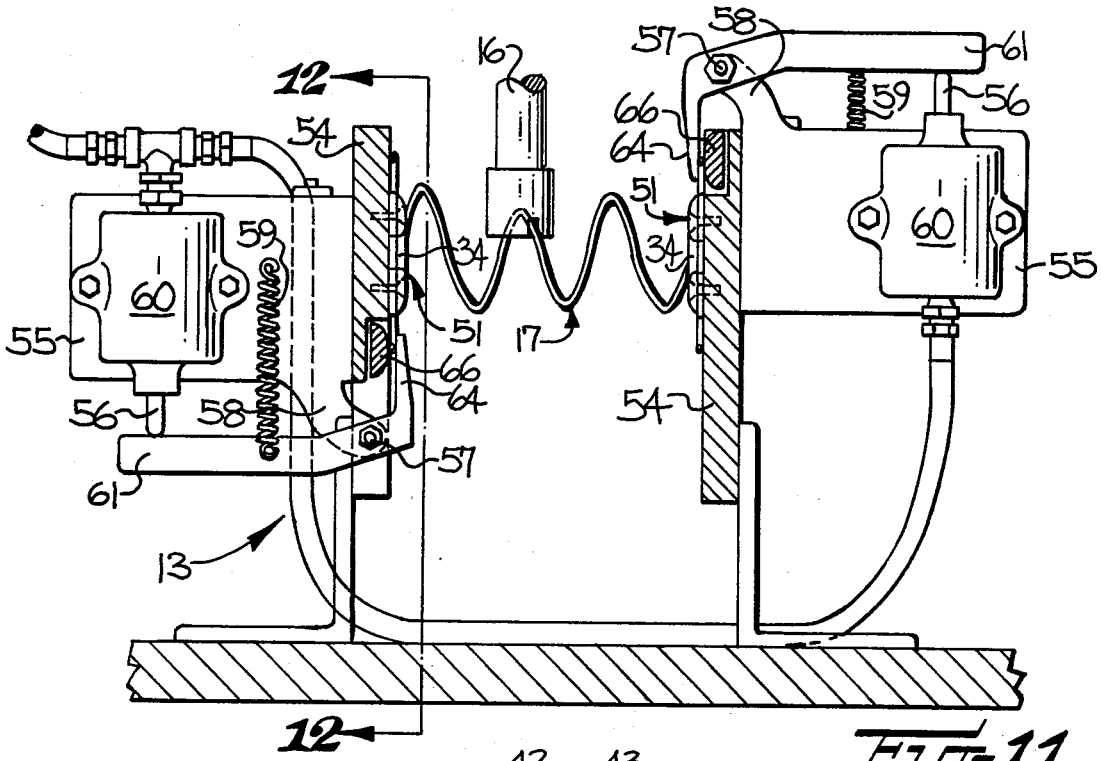
FIG. 11 is a cross-sectional view taken about the line 11—11 of FIG. 5.

Referring to FIGS. 9 and 10, it will be noted that movement of the die driver 22 results in interaction between the cams 26 carried by the driver, and cams 41 carried by the stripper bars 40. Specifically, the stripper bars 40 are held away from the driver when the piston 29 of the cylinder 20 is in the retracted position. As the piston is extended, the cams 26 and 41 are moved out of contact whereby the stripper bars drop to a retracted position, this settling the end convolutions in a forming position. Specifically, this provides for freedom of movement of the male dies 50 relative to the female dies 51. Upon the return stroke of the piston 29, the cams 26 are again driven against the cams 41 thereby forcing the stripper bars inwardly relative to the female dies. This, in turn, forces the end convolutions of the coil springs out of the female dies so that the transfer arms can freely carry the coil springs away from the indentation station.

The arrangement described above is designed for the formation of single indentations 18 in the end convolutions of a coil spring. FIGS. 18 and 19 illustrate a contemplated variation wherein a pair of indentations are formed in coil springs. In these illustrations, the reference numerals are associated with the letter "A" with the numbers identifying parts the same as those having such numbers in the previous description. The "double indentation" is achieved by corresponding operations, with a pair of projections 33A cooperating with a pair of recesses 34A to achieve the desired result.

Figure 12:
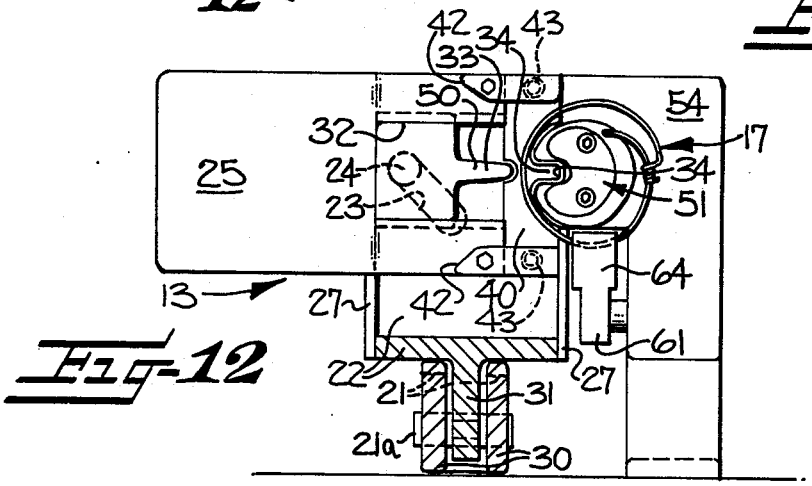
FIG. 12 is a cross-sectional view taken about the line 12—12 of FIG. 11.
Figure 13:
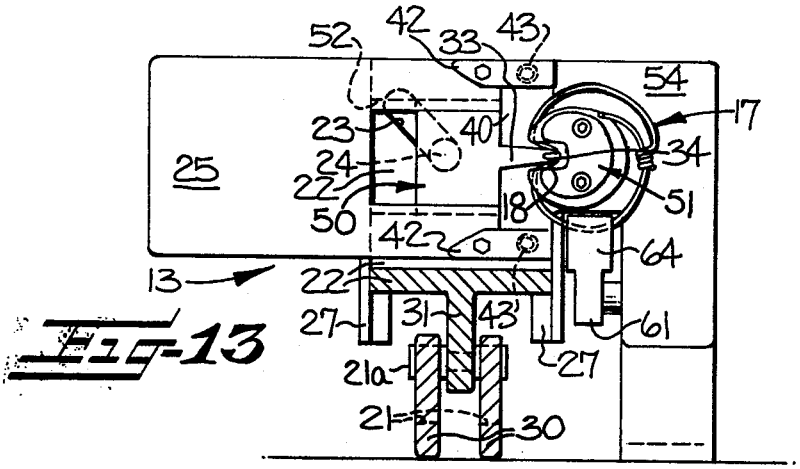
FIG. 13 is a cross-sectional view of the structure shown in FIG. 12 at a different operating stage.

FIG. 20 illustrates a portion of a circuit diagram useful for describing a possible operating cycle. In this diagram, a first mechanical switch 28 is, as previously noted, adapted to be operated by the transfer arm mechanism when the transfer arms are properly located relative to the respective stations. A first relay 70 is adapted to be operated by the switch 28, and this relay operates to open normally closed contacts 71 to stop transfer arm motor 73. In this manner, the system serves to stop the transfer arms when the coil springs are positioned as shown in FIGS. 12 and 13.

The relay 70 also operates to close normally open contacts 72 whereby the solenoid 74 is actuated for operating air cylinder 60 to apply clamps 61. The coil heat treating operation can also be initiated by closing of these contacts, for example by operating high current contactor 75. Relay 70 also operates to close normally open contacts 76 which operates solenoid 78. This solenoid operates cylinder 20 whereby male dies 50 will serve to form the indentations 18.

The relay 70 may be a time delay relay so that the operations, particularly the heating operation, will be sustained for a suitable duration. When the relay releases, the solenoids 74 and 78 will be de-energized and motor 73 restarted to commerce the next cycle.

It will be appreciated that the circuit operation is provided only as an example of a suitable arrangement. Switch positions can be readily varied, and substitutions readily made, for example, photo-sensitive means in place of mechanical switches. It is also contemplated that the circuit could be supplemented by and otherwise operated by timing mechanisms which control the various movements in a desired sequence. Such circuit operations are well within the skill of designers.

It will be understood that various changes and modifications may be made in the above described system which provide the characteristics of the invention without departing from the spirit thereof particularly as defined in the following claims.

That which is claimed is:

1. In an automatic machine for the production of assemblies of coil springs wherein wire is fed to a coiling station whereat individual coil springs are successively formed and severed from the wire, transport arm means are provided for delivering the coil springs one at a time to an assembling station, and means are provided in the assembling station for tying the individual coil springs into complete assemblies, the improvement comprising means for automatically forming an indentation in the opposite end convolutions of each coil spring, said indentation means being located in the path of movement of said transport arm between said coiling station and assembling station, said indentation means including dies positioned on opposite sides of said path of movement for receipt of each coil spring carried by said transport arm, means for temporarily stopping said transport arm movement when a coil spring held thereby is received by said dies, said dies including reciprocally movable forming members for engaging said end convolutions to form said indentations, and means for restarting said transport arm movement after formation of said indentations for movement to said assembling station whereby each coil in said complete assemblies includes said indentations.

2. A machine in accordance with claim 1 including a plurality of said transport arms located on a common mounting, and means for driving the transport arms in succession for receipt by said dies.

3. A machine in accordance with claim 2 including a coil heat treating station between said coiling station and said assembling station, said dies being located at said heat treating station whereby said coils are heat treated at substantially the same time that the indentations are formed.

4. A machine in accordance with claim 3 including means for clamping said opposite end convolutions of said coils at said heat treating station, means for passing electrical current between said clamping means for resistance heating of said coils, said clamping means holding said coils during operation of said dies.

5. A machine in accordance with claim 1 including opposed guide means defining bearing surfaces for engaging said opposite end convolutions as said transport arm moves said coils between said dies, said dies including first and second die members formed as continuations of said bearing surfaces whereby said end convolutions engage outer surfaces defined by said die members, and a gap defined between the first and second die members for receipt of said end convolutions.

6. A machine in accordance with claim 5 wherein said second die members are movable relative to said first die members across said gap for engagement with said end convolutions after stopping of said transport arm.

7. A machine in accordance with claim 6 including stripper means adapted to be driven outwardly into said gap into engagement with said end convolutions for driving said end convolutions out of engagement with said first die members, said stripper means being driven outwardly after formation of said indentations.

8. A machine in accordance with claim 7 including means for retracting said stripper means in response to movement of said second die members across said gap whereby said end convolutions are free to move between said first and second die members.

* * * * *